United States Patent [19]

Bustos

[11] 4,346,806

[45] Aug. 31, 1982

[54] SHELF ORGANIZER

[75] Inventor: Rafael T. Bustos, Clarkston, Ga.

[73] Assignee: Leggett & Platt, Incorporated, Carthage, Mo.

[21] Appl. No.: 129,342

[22] Filed: Mar. 11, 1980

[51] Int. Cl.[3] ..... A47F 7/00

[52] U.S. Cl. ..... 211/49 S; 211/184; 108/61

[58] Field of Search ..... 211/49 D, 184, 49 S; 108/60, 61

[56] References Cited

U.S. PATENT DOCUMENTS

| | | | |
|---|---|---|---|
| 2,111,496 | 3/1938 | Scriba | 211/49 D |
| 3,110,402 | 11/1963 | Mogulescu | 211/49 D |
| 3,185,307 | 5/1965 | Higgins | 211/184 X |
| 3,279,618 | 10/1966 | Bergstedt | 211/49 D |
| 3,501,019 | 3/1970 | Amrstrong et al. | 108/61 |

*Primary Examiner*—William F. Pate, III

*Attorney, Agent, or Firm*—Wood, Herron & Evans

[57] ABSTRACT

A shelf organizer comprising a series of wires, the ends of which extend downwardly perpendicular to the length of the wires and are received into edge pockets of sheets of corrugated plastic material. When the sheets of plastic material are secured to the front and rear edges of a shelf, the spaced wires form columns within which shelf displayed objects may be placed and thereby organized into spaced columns.

10 Claims, 5 Drawing Figures

SHELF ORGANIZER

This invention relates to a device for separating columns of objects, as for example bottles or cans, on a display shelf.

It is standard practice to arrange objects on a display shelf in columns so that as an object at the front of the shelf is removed, the next following like object is exposed. It is also common practice to arrange the objects in columns on a tilted shelf with an abutment at the front of the shelf so that as objects are removed from the front of the shelf, the remaining objects in the column move forwardly until the forwardmost object contacts the front abutment. Such an arrangement is illustrated and described in U.S. Pat. No. 3,203,553. As an alternative to a tilted shelf, the objects may be supported upon a movable belt which may or may not be tilted but which is operative to feed objects in the column from which the forwardmost object is removed forwardly until the forwardmost object contacts an abutment surface at the front of the shelf. Such a belt feed arrangement is disclosed in U.S. Pat. No. 4,128,177 or U.S. Pat. No. 3,166,195.

Whenever columns of cylindrical objects, such as bottles or cans are automatically fed forwardly on a display shelf, either by gravity or by a belt feed, there is a tendency for the objects in the columns to slide sideways out of alignment. Therefore, it is common practice to organize such automatic forward feed shelves into columns with separators or so-called "organizers" between the columns for maintaining the spacing of the columns. Such organizers are commonly in the form of wires located on opposite sides of each column as in U.S. Pat. No. 4,128,177.

One of the limitations of all commercially available shelf organizers of which I am aware is the difficulty or impossibility of changing the spacing between the organizers as is desirable whenever the size of objects displayed on the shelf is changed.

Another severe limitation of all currently available shelf organizers of which I am aware is the fact that they must either be assembled at the shelf site or if pre-assembled, are very expensive to ship to the shelf site. Ideally, the organizers should be capable of shipment as an assembled but collapsed item so as to avoid having unskilled store personnel assemble the organizers while still retaining relatively low shipment costs.

It has therefore been an objective of this invention to provide an improved shelf organizer structure which is easily capable of rearrangement to change the spacing of the columns to accommodate varying size objects.

Still another object of this invention has been to provide a shelf organizer which may be pre-assembled at the manufacturing site and then collapsed for shipment so as to facilitate assembly at the display shelf site while still minimizing shipment costs.

The invention of this application which accomplishes these objectives comprises spacers in the form of horizontal wires, the ends of which extend vertically downwardly and are received within open end pockets of a sheet of corrugated plastic. This sheet of plastic is preferably scored and folded into a generally L-shaped configuration so that the horizontal leg of the sheet may be secured, as by a pressure sensitive adhesive, to the top surface of a display shelf. For shipment purposes, the corrugated sheet is folded flat and the sheets are placed in side-by-side juxtaposition with the vertical legs of the wire remaining in the pockets. At the display shelf site, assembly requires no more than moving the corrugated sheets apart to the extent permitted by the wires and folding the corrugated sheets into the L-shaped configuration for attachment to the shelf.

The primary advantage of this organizer is that is is very inexpensive to manufacture and to ship as an assembled item. It also has the advantage of being capable of being rearranged with a minimum of effort to accommodate varying size objects in the columns between the organizer wires.

These and other objects and advantages of the invention will be more readily apparent from the following description of the drawings in which.

Figure 1:
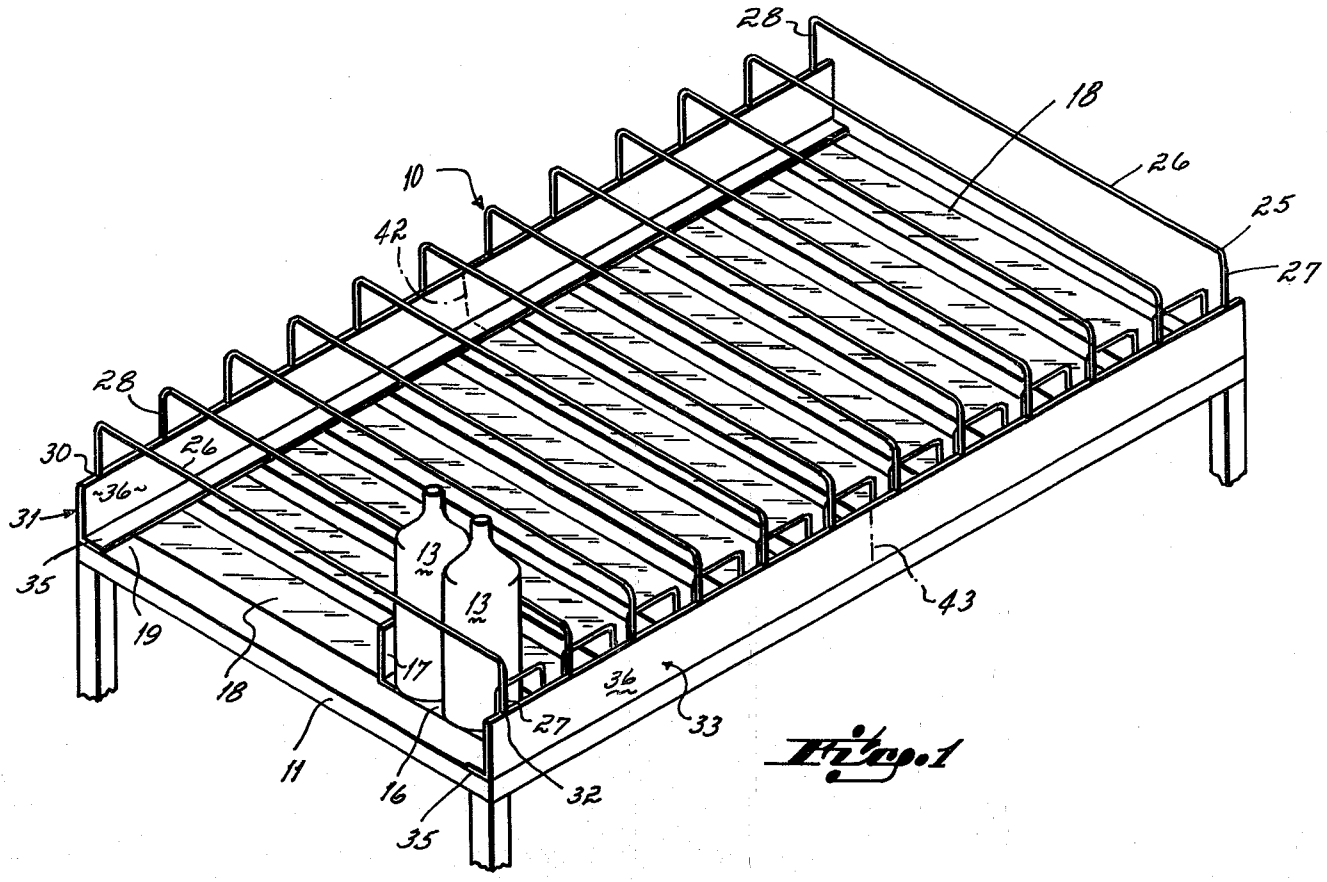
FIG. 1 is a perspective view of a shelf having the organizer of this invention mounted thereon.

With reference first to FIG. 1, there is illustrated the shelf organizer 10 of this invention as applied to a shelf 11 upon which there is also mounted a plurality of forward feed devices 12 for feeding columns of bottles 13 forwardly on the shelf as the forwardmost bottles in the column are removed. The forward feed device 12 comprises a bracket 15 adapted to be secured to the front of the shelf for supporting a roller (not shown) around which there is wrapped a flexible belt 16. A torsion spring (not shown) is contained internally of the roll and is operable when the belt is unwound from the roll to effect automatic rewinding of the belt onto the roll. An abutment 17 is secured to the outer end of the belt remote from the roller. This abutment engages the rearwardmost bottle in the column so as to prevent that rearwardmost bottle from sliding off of the belt and to cause the belt to unwind from the roller as additional bottles are placed on the forward end of the belt. Preferably, a low friction tape 18 is adhered to the top surface of the shelf such that the tape extends from adjacent the rearwardmost edge of the device 12 to the back edge 19 of the shelf 11. A low friction top surface on this tape, as for example, a Teflon top surface presents a very slick surface to the belt over which the belt 16 may slide with a minimum of friction.

The forward feed device 12 and tape 18, per se, form no part of the invention of this application. They are only illustrated and described herein for purposes of illustrating one application of the shelf organizer 10 which is the subject matter of the invention of this application. A more detailed description of the forward feed device 12 may be found in William B. Taylor's co-pending application Ser. No. 129,341 which was filed on even date herewith and is assigned to the assignee of this application.

When the forward feed device 12 is used to feed cylindrical objects, there is a tendency for the objects to be pushed to one side or the other off of the belt 16 and out of columnar alignment. Therefore, in these applications, guide wires or so-called organizer wires 25 are located on opposite sides of the columns above the top surface of the shelf so as to prevent any lateral movement of the bottles or objects out of the columnar alignment.

Figure 2:
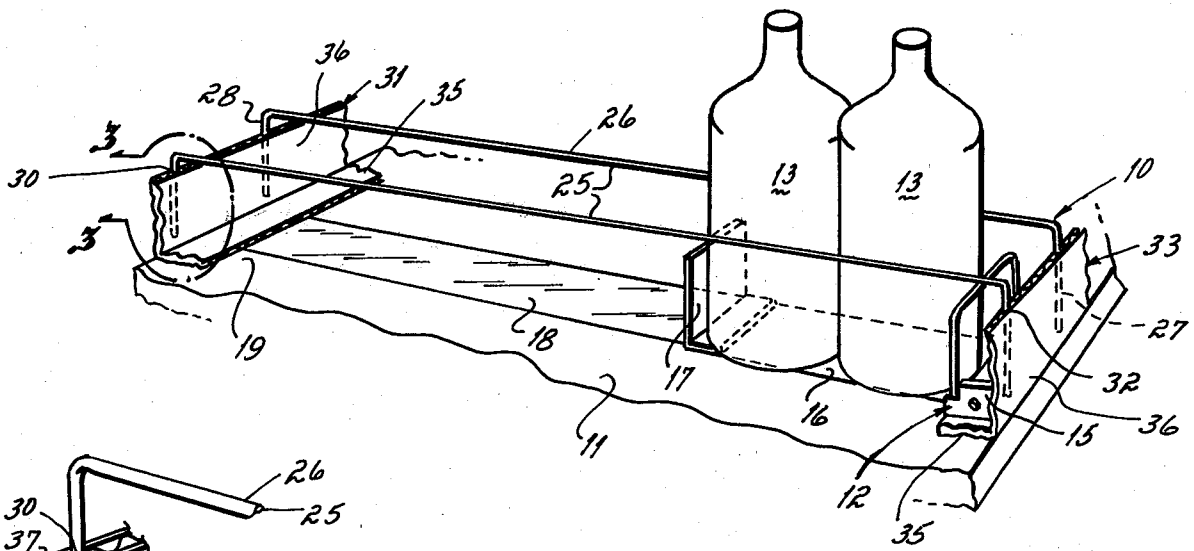
FIG. 2 is an enlarged perspective view of a portion of FIG. 1.
Figure 3:
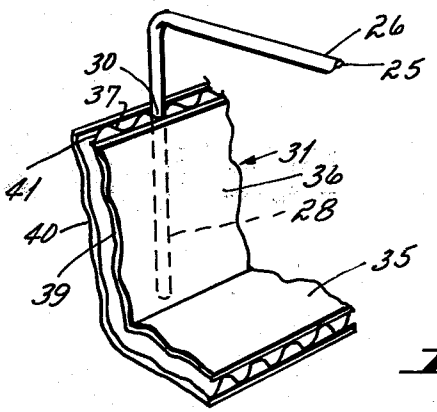
FIG. 3 is an enlarged perspective view of the portion of FIG. 2 encircled by the line 3—3.

With reference to FIGS. 1 and 2, it will be seen that the organizer wires 25 are generally U-shaped, having a longitudinally extending section 26 from which vertical sections 27 and 28 extend downwardly at the front and rear ends. The vertical section 28 at the rear end of the organizer wires are fitted in recesses or pockets 30 of a corrugated sheet of material 31 located at the rear 19 of the shelf and the vertical sections 27 at the front end of the wires are fitted into pockets 32 of another corrugated sheet of material 33 located at the front of the shelf. These sheets of corrugated material are generally slit or scored along a score line so that they may be bent into a right angle configuration having a horizontal section 35 secured to the top surface of the shelf and a vertical section 36 extending therefrom. The vertical sections 27, 28 of the organizer wires fit into the exposed end pockets or corrugations 37 of the corrugated material.

In the preferred embodiment, the corrugated material is double-faced corrugated plastic. It comprises flat top and bottom sheets 39 and 40 of polyethylene between which a corrugated sheet 41 of polyethylene is sandwiched. Except for color, the corrugated plastic material resembles double-face corrugated cardboard.

As an alternative to this corrugated plastic material, an extruded plastic could be substituted which has a continuous series of pockets or recesses formed over the length thereof.

Figure 4:
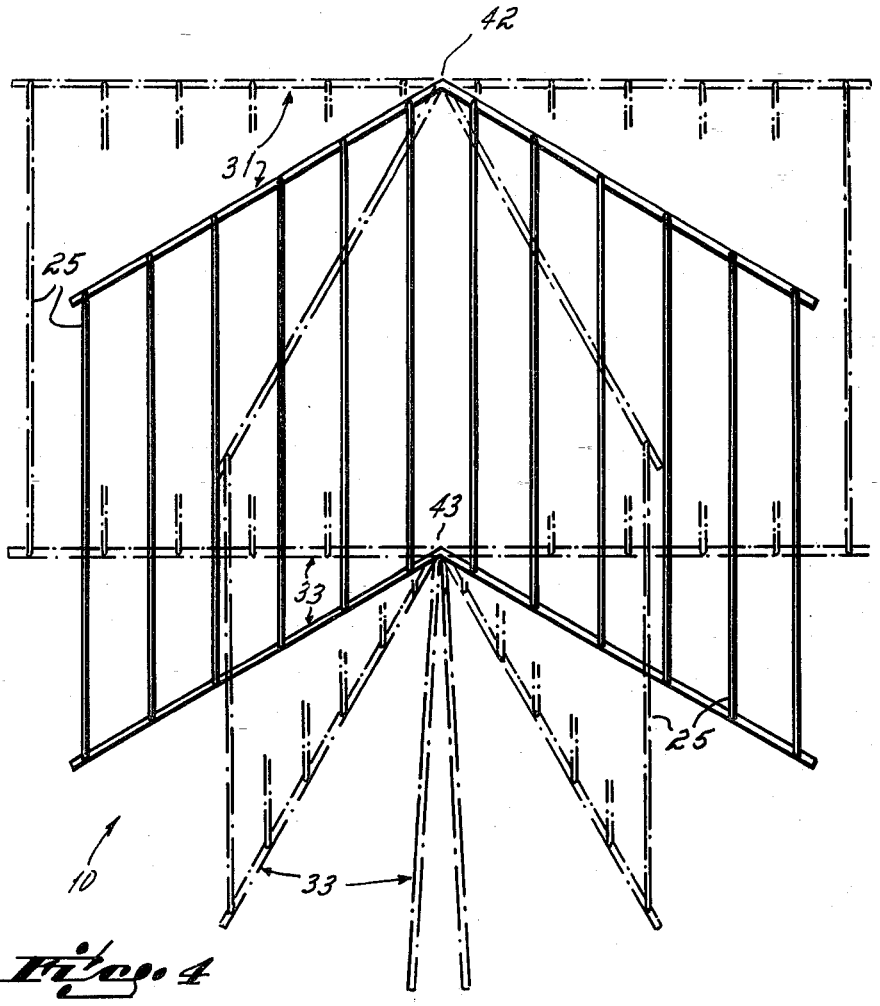
FIG. 4 is a top plan view of the organizer of this invention illustrating in phantom lines the manner in which it is folded for shipment.
Figure 5:
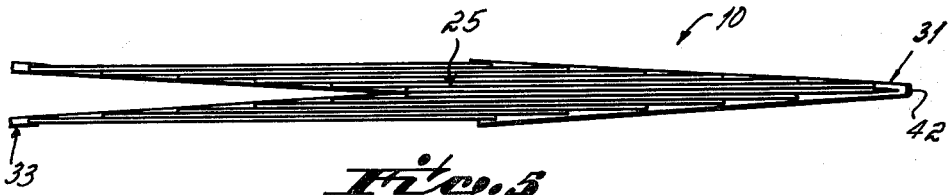
FIG. 5 is a top plan view of the fully folded organizer in the position in which it is ready for shipment.

With reference to FIGS. 4 and 5 it will be seen that the organizer 10 is particularly advantageous for shipping in that it may be preassembled and then shipped as a flattened package. To that end, the wires 25 may be preassembled into the pockets 30, 32 of the corrugated sheets 31, 33 and the corrugated sheets 31 and 33 may be flattened to locate the horizontal and vertical legs 35, 36 of the corrugated sheets in a common plane.

The now planar sheets 31, 33 may then be folded about central vertical score lines 42, 43 while the wires 25 remain within the selected pockets of the sheets. When fully folded, the organizer 10 has the configuration illustrated in FIG. 5 as viewed in a top plan view. This configuration is very compact and therefore inexpensive to ship as an assembled organizer.

The flattened preassembled device may be assembled at the shelf site by simply unfolding the folded sheets 31, 33 so as to move the corrugated sheets 31, 33 into a single vertical plane and then moving them the maximum distance apart of which they are capable of moving so long as the wires remain in the pockets 37 of the corrugated sheets 31, 32. The bottom sections 35 of the front and rear sheets 31, 33 may then simply be folded into the horizontal plane and adhered to the top surface of the shelf. As illustrated in FIG. 2, the forward feed device 12 may then be adhered to the top surface of the horizontal section 35 of the front sheet 33 if such a device is to be used in association with the organizer 10.

The primary advantage of this invention, in addition to the fact that it may be preassembled and shipped as a flattened assembly, resides in the fact that it is manufactured from very inexpensive materials and that it accommodates the organizer wires 25 in any one of numerous different positions of adjustment by simply changing the corrugated slot within which the wires are located. Accordingly, a shelf may be reorganized very quickly to accommodate columns of different width objects as for example bottles of different sizes.

While I have described only a single preferred embodiment of my invention, persons skilled in this art will appreciate numerous changes and modifications which may be made without departing from the spirit of my invention. Specifically, they will readily appreciate that this organizer may be used on gravity feed shelves upon which the bottles or other objects slide relative to the shelf as well as your shelves which have belts for moving the objects forwardly. Additionally, the organizer may be used to organize shelves upon which there is no automatic forward feed of the objects. Therefore, I do not intend to be limited except by the scope of the following appended claims.

I claim:

1. A shelf organizer comprising, a plurality of horizontal wires having end sections extending downwardly from the opposite ends thereof, two sheets of corrugated plastic material, each of said sheets comprising at least one generally flat ply of plastic material and one corrugated ply of plastic material, each of said sheets being scored longitudinally thereof such that the sheets may be folded about the longitudinal score line to locate one section of each of said sheets including both said generally flat ply and said corrugated ply in a horizontal plane and the other section including both said generally flat ply and said corrugated ply in a vertical plane, the vertical section having an exposed edge generally parallel to the score line, vertically extending pockets in said vertical section of each of said sheets of corrugated plastic material, said pockets being defined between the corrugations of said corrugated plastic material and said pockets being open at said exposed edge, and one end section of each of said wires extending downwardly into a pocket of one of said corrugated sheets of plastic material.

2. The shelf organizer of claim 1 in which the bottom side of the horizontal section of each of said sheets of corrugated plastic material has a pressure sensitive adhesive applied thereto, said sheets being adapted to be secured to a top surface of a display shelf by said adhesive.

3. The shelf organizer of claim 1 in which the pockets within which the end sections of said wires are located are equidistantly spaced along the length of each of said sheets.

4. The shelf organizer of claim 1 which further includes means for enabling said shelf organizer to be collapsed into a flat condition while said end sections of said wires are maintained within said pockets.

5. The shelf organizer of claim 4 wherein said collapsed condition enabling means includes a second score line within each of said sheets and extending generally perpendicular to said longitudinal score line of each of said sheets.

6. A shelf organizer comprising, a plurality of horizontal wires having end sections extending downwardly from the opposite ends thereof, at least one sheet of corrugated plastic material, said sheet comprising at least one generally flat ply of plastic material and one corrugated ply of plastic material, said sheet being scored longitudinally thereof with at least one longitudinal score line such that the sheet may be folded about the score line to locate one section of said sheet including both said generally flat ply and said corrugated ply in a horizontal plane and at least one other section including both said generally flat ply and said corrugated ply in a vertical plane, the vertical section having an exposed edge generally parallel to the score line, vertically extending pockets in said vertical section of said sheet of corrugated plastic material, said pockets being defined between the corrugations of said corrugated plastic material and said pockets being open at said exposed edge, and one end section of each of said wires extending downwardly into a pocket of said corrugated sheet of plastic material.

7. The shelf organizer of claim 6 in which the pockets within which the end sections of said wires are located are equidistantly spaced along the length of each of said sheets.

8. The shelf organizer of claim 6 which further includes means for securing said sheet of corrugated plastic material to a display shelf.

9. The shelf organizer of claim 6 which further includes means for enabling said shelf organizer to be collapsed into a flat condition while said end sections of said wires are maintained within said pockets.

10. The shelf organizer of claim 9 wherein said collapsed enabling means includes a second score line within each of said sheets and extending generally perpendicular to said longitudinal score line of said sheet.

* * * * *